United States Patent [19]

Yoshida

[11] 4,313,186

[45] Jan. 26, 1982

[54] ELECTRONIC TIMEPIECE WITH TIME ZONE CHANGE FEATURES

[75] Inventor: Kunio Yoshida, Tsugemura, Japan

[73] Assignee: Sharp Kabushiki Kaisha, Osaka, Japan

[21] Appl. No.: 889,906

[22] Filed: Mar. 24, 1978

[30] Foreign Application Priority Data

Mar. 25, 1977 [JP] Japan ..... 52/33805

[51] Int. Cl.[3] ..... G04B 19/22

[52] U.S. Cl. ..... 368/22

[58] Field of Search ..... 58/4 A, 23 R, 42.5, 58/44, 50 R, 152 R, 152 G; 364/569, 705

[56] References Cited

U.S. PATENT DOCUMENTS

| | | | |
|---|---|---|---|
| 3,653,204 | 4/1972 | Miwa | 58/42.5 |
| 3,940,920 | 3/1976 | Nakamura et al. | 368/21 |
| 3,955,355 | 5/1976 | Luce | 58/50 R |
| 4,072,005 | 2/1978 | Teshima et al. | 58/42.5 |
| 4,086,654 | 4/1978 | Ido et al. | 364/705 |
| 4,133,170 | 1/1979 | Kashio | 58/42.5 |
| 4,217,653 | 8/1980 | Nakata | 368/21 X |

*Primary Examiner*—Vit W. Miska

*Attorney, Agent, or Firm*—Birch, Stewart, Kolasch and Birch

[57] ABSTRACT

An electronic timepiece with a digital display includes a timekeeping circuit which stores the present time in a specific geographical region A, a keyboard adapted to introduce a time difference between two geographical regions A and B, and a calculation circuit which executes a time zone change operation by means of the contents of the timekeeping circuit and the time difference introduced via the keyboard, thereby loading the timekeeping circuit with the results of the time zone change operation instead of the previously stored horological information. When one desires to obtain a time zone change in another region C, the time difference is introduced into the timekeeping circuit storing the present time in the time zone B.

5 Claims, 4 Drawing Figures

ELECTRONIC TIMEPIECE WITH TIME ZONE CHANGE FEATURES

BACKGROUND OF THE INVENTION

The present invention relates to improved time zone change features for use in an electronic timepiece.

Electronically controlled time zone change features are well known in the art of horology. A typical example of a prior art timepiece with electronically controlled time zone change features is fully disclosed and illustrated in U.S. Pat. No. 3,955,355 entitled "ELECTRONIC CALCULATOR WATCH STRUCTURES" and granted to Nunzio A. Luce. A shortcoming with such a prior art timepiece is that the time zone change operation shown therein needs an additional timekeeping circuit similar in construction and operation to a reference timekeeping circuit storing reference horological information.

SUMMARY OF THE INVENTION

The present invention obviates the above-mentioned shortcoming by providing an improved time zone change scheme which is especially simple in construction.

In its broadest aspect, the present invention comprises a timekeeping means for storing horological information, input means for introducing a time difference between at least two geographical regions for storage, first calculation means for obtaining a relative time difference between these regions while viewing the horological information stored in said timekeeping means as the present time in one A of these two regions, and second calculation means for obtaining the present time in the other B by means of the horological information within said timekeeping means and the relative time difference. One aspect of the present invention is that a time difference of each of the geographical regions is introduced and stored as an absolute time difference with respect to Greenwich mean time or Greenwich mean time plus a specific integer. While the horological information within said timekeeping means is viewed as being relevant to the present time in the first region A, a relative time difference in the second region B is then calculated. A time zone change is carried through by a calculation of the contents of the timekeeping means and the obtained relative time difference, thereby calculating the present time in the time zone B. The present time in the respective regions can be calculated with flexibility. All that is necessary to implement the time zone change operation is to introduce and store absolute time differences of respective geographical regions. This eliminates the necessity for a matrix arrangement as shown in the above referenced patent which stores all combinations of relative time differences between respective geographical regions. In addition, the contents of the timekeeping means of the present invention can be changed at ease, whereas the reference timekeeping means itself can not be altered in the above referenced patent.

Other objects and further scope of applicability of the present invention will become apparent from the detailed description given hereinafter; it should be understood, however, that the detailed description and specific examples, while indicating preferred embodiments of the present invention, are given by way of illustration only, since various changes and modifications within the spirit and scope of the invention will become apparent to those skilled in the art from this detailed description.

BRIEF DESCRIPTION OF THE DRAWINGS

A better understanding of the present invention may be had from a consideration of the following detailed description taken in conjunction with the accompanying drawings in which.

DETAILED DESCRIPTION OF THE INVENTION

Provided that the present time in a geographical region A and a time difference between the geographical region A and a second region B are known, it is possible to calculate the present time in the second region B. If both the regions A and B are determined with flexibility, for example, various famous cities throughout the world, these combinations are numerous with an accompanying store which is huge enough to store time differences of all these combinations.

Contrarily, if a third region C is specified and time differences between the regions C and A and between the regions C and B are known, a relative time difference between the regions A and B can be newly calculated from those two time differences. A calculation of the present time in the region A and the relative time difference leads to the present time in the region B. The present time $T_B$ in the region B can be represented by the following equation wherein $T_A$ is the present time in the region A, $t_{CA}$ is the time difference of the region A with respect to the specified region C and $t_{CB}$ is the time difference between the regions C and B:

$$\begin{aligned} T_B &= T_A - (t_{CB} - t_{CA}) \\ &= T_A + t_{CA} - t_{CB} \end{aligned}$$

It will be noted that those time differences $t_{CA}$ and $t_{CB}$ are a positive integer when times in the regions A and B are behind that in the region C and a negative integer when they are ahead of the time in region C. By way of example, Tokyo time is 6:50 and then the user desires to obtain New York time. While viewing Greenwich mean time as a reference, Tokyo time is nine hours ahead of Greenwich mean time and New York time is five hours behind Greenwich mean time. $t_{CA} = -9$ hours and $t_{CB} = 5$ hours. If Tokyo time is now 6:50, the time $T_B$ in New York is 16:10 of the previous day as follows:

$$\begin{aligned} T_B &= T_A + t_{CA} - t_{CB} \\ &= 6{:}50 + (-9 \text{ hours}) - (5 \text{ hours}) \\ &= 6{:}50 - 14 \text{ hours} \\ &= -7{:}50 \\ &= 24 \text{ hours} - 7{:}50 \\ &= 16{:}10 \end{aligned}$$

Since it is only necessary to obtain the relative time differences of the regions A and B, any other reference time rather other than Greenwich mean time can be useful for the purpose of the present invention. The time differences $t_A$ and $t_B$ can be zero or a positive integer provided that the region where time is X hours ahead of Greenwich mean time is selected and the time differences with respect to Greenwich mean time are added by X hours.

$$t_A = t_{CA} + X$$
$$t_B = t_{CB} + X$$

Thus, $$\begin{aligned} T_B &= T_A + t_A - t_B \\ &= T_A + (t_{CA} + X) - (t_{CB} + X) \\ &= T_A + t_{CA} - t_{CB} \end{aligned}$$

The same result is available. When it is desired to make all time differences throughout the world zero or a positive integer, X should be not less than 13 because the possible maximum time difference with respect to Greenwich mean time is 13 hours.

Figure 1:
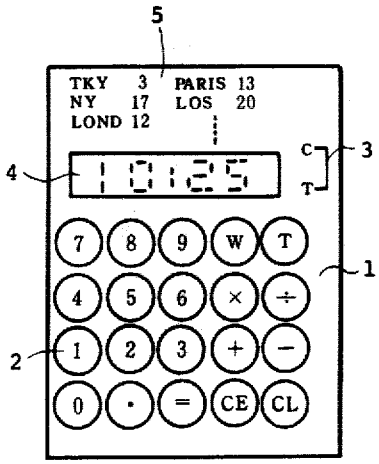
FIG. 1 is a perspective view of one preferred embodiment of the present invention.

FIG. 1 shows a perspective view of a combined calculator and clock embodying the teachings of the present invention. It is obvious to those skilled in the art that the present invention is equally applicable to an electronic clock, an electronic watch and so on. The given example comprises essentially a body 1, a keyboard 2, a mode selector 3 for selecting the calculator mode C or the timepiece mode T, a display 4 for a visual display of horological information or operation results and a time difference table 5 engraved or adhered to the body 1. Table 1 is depicted where time differences with respect to Greenwich mean time plus 12 hours are viewed as absolute time differences.

TABLE 1

| Greenwich mean time | Regions | Digits used |
|---|---|---|
| −9 | Japan | 3 |
| +5 | New York | 17 |
| 0 | London | 12 |
| −1 | Paris | 13 |
| +8 | Los Angeles | 20 |

Keys W and T of the keyboard 2 are operated to provide a readout of horological information in a specific region.

Figure 3A:
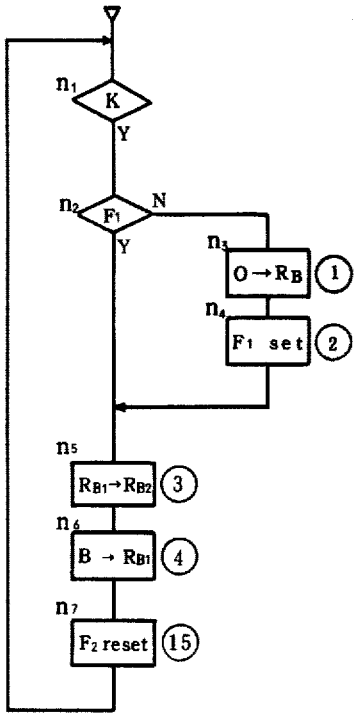
FIG. 3(*a*) and FIG. 3(*b*) are flow charts for illustrating operation of the embodiment of FIG. 1.
Figure 3B:
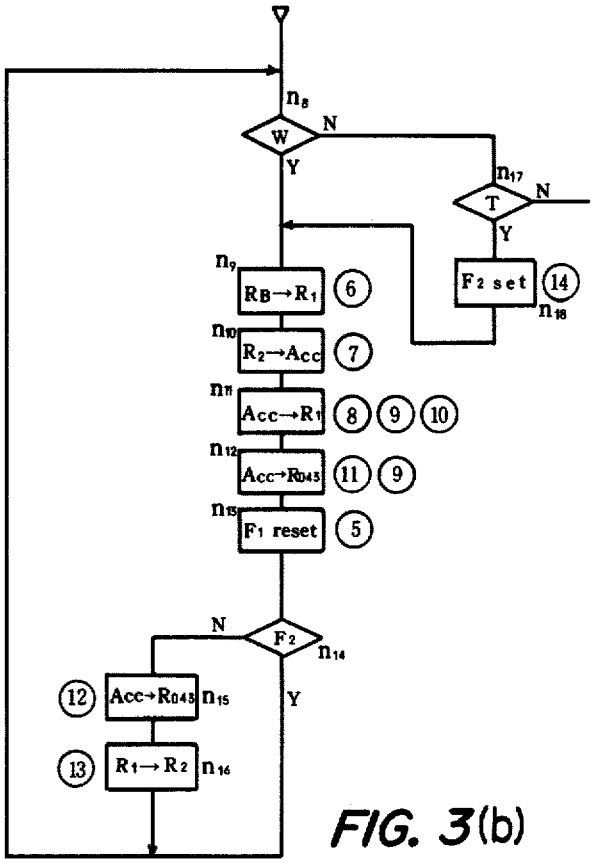
Figure 2:
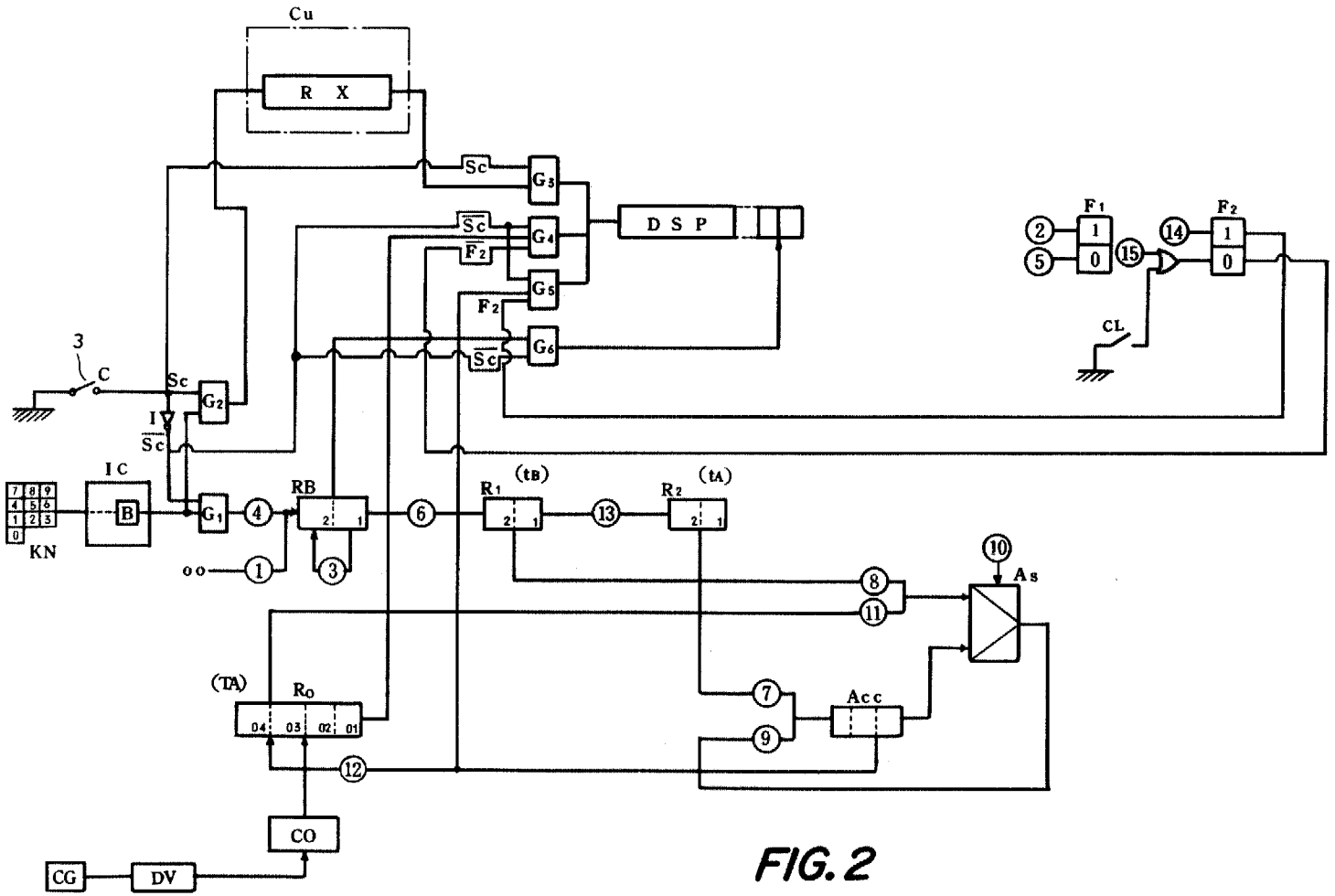
FIG. 2 is a block diagram of logic construction used with the embodiment of FIG. 1.

FIGS. 2, 3(*a*) and 3(*b*) are a block diagram and flow charts showing the time zone change function of the present invention.

There is provided a register $R_O$ for storing horological information (hours and minutes in the given example), a clock oscillator CG, a frequency divider DV, and a timekeeping counter CO which updates or increments the counts of the register $R_O$ every unit time, for example, every one minute. This further comprises a group of digit keys KN of the keyboard 2, and a key depression determination circuit IC which contains an encoder for converting digit inputs into a binary code and a data buffer B of one-digit capacity. Two-digit numerical registers $R_B$, $R_1$ and $R_2$ are further provided with $R_B$ for temporary storage of time differences, $R_1$ for storage of the time difference $t_B$ and $R_2$ for storage of the time difference $t_A$. An output register ACC is able to store two-digit numerals and a plus or minus sign. An adder/subtractor AS performs an appropriate operation on the numerical storage registers $R_1$ and $R_2$ and the timekeeping register $R_O$. The given example includes a calculation control or processor unit CU and a numerical storage register RX implemented within the calculation control CU. In addition, R-S type flip-flops $F_1$ and $F_3$, logic gates $G_1$ to $G_6$ and micro-instruction ① to ⑮ are required. DSP denotes a display register.

Assume now that the mode selector 3 is positioned to select the calculator mode C. The logic gate $G_2$ is enabled in response to a mode signal $S_C$ so that inputs from the digit key group KN are introduced into the register RX within the calculator control CU and simultaneously displayed on the display 4 of FIG. 1 through the display register DSP. Operation results are introduced likely into the numerical register R and displayed on the display 4.

If the timepiece mode T is rendered active by the mode selector 3, then a mode signal $\bar{S}_C$ inverted via an inverter I enables the logic gate $G_1$.

When a specific digit key of the digit key group KN is manually operated in the timepiece mode, the steps $n_1$ $n_2$ as shown in FIG. 3(*a*) are effected. In case of the first entry, the step $n_3$ is reached because of the flip flop $F_1$ in the reset state. The step $n_3$ brings about the development of the micro-instruction ① which loads the buffer storage register $R_B$ with "00" and resets the same to all zeros. In the next step $n_4$ the micro-instruction ② urges the R-S type flip flop $F_1$ into the set state, followed by the step $n_5$. The micro-instruction ③ in the step $n_5$ causes the contents of the first digit $R_{B1}$ of the buffer $R_B$ to be transferred to the second digit $R_{B2}$ thereof. At this time no substantial change occurs because the first digit $R_{B1}$ and the second digit $R_{B2}$ store zero because of step $n_3$. The micro-instruction ④ in the step $n_6$ causes the just introduced numerical information to shift from the buffer register B to the first digit $R_{B1}$ of the buffer $R_B$. The function of the step $n_7$ is to develop the micro-instruction ⑮ and reset the R-S type flip flop $F_2$ as far as the digit entry is evaluated.

When the second entry or the depression of a next digit key is carried through, the steps are executed in a sequence $n_1 \rightarrow n_2$ and then skipped to the fifth step $n_5$ since the R-S type flip flop $F_1$ is latched in the set state during the previous data entry. The buffer register $R_B$ is subject to the left shift procedure wherein the previously entered information is transferred into the second digit position $R_{B2}$ and the secondly entered digit information is transferred from the buffer B into the first digit position $R_{B1}$.

If these two digits are introduced by the operation of the digit key group KN in this manner, they are stored into the buffer register $R_B$. When "13" corresponding to Paris time, for example, is selected, "1" is loaded into the second digit position $R_{B2}$ and "3" is loaded into the first digit position $R_{B1}$.

Subsequently, the step $n_8 \rightarrow n_9$ are sequentially executed upon the depression of the key W. The step $n_8$ determines whether a key depressed is relevant to the key W and, if so, advances toward the step $n_9$ where the micro-instruction ⑥ is developed to transfer the contents of the buffer register $R_B$ into the first register $R_1$. Eventually, the first register $R_1$ keeps the time difference $t_B$ of the region B which is sought to calculate the present time.

Meantime, the second register $R_2$ is storing the time difference $t_A$ of the region A of which the present time $T_A$ is stored within the timekeeping register $R_O$. In the succeeding step $n_{10}$, the micro-instruction ⑦ is developed with transmission of the contents $t_A$ from the second register $R_2$ to the output register ACC. The micro-instructions ⑧, ⑨ and ⑩ help in executing subtraction of the contents of the output register ACC from that of the first register $R_1$. The results of such subtraction are returned back to the output register ACC. The adder/subtractor AS operates in the subtractor mode in response to the micro-instruction 10 and in the adder mode otherwise. In this way, the subtraction operation is executed to calculate the relative time difference $(t_A-t_B)$ between the regions A and B during the step $n_{11}$. The next step $n_{12}$ is executed which generates the micro-instructions ⑪ and ⑨ and executes addition of the tens hours and hours contents of the timekeeping register $R_O$ to the output register ACC. The addition results are stored back to the output register ACC. The contents of the output register ACC correspond to $T_A+(t_A-t_B)$.

During the step $n_{13}$ the micro-instruction ⑤ resets the R-S type flip flop $F_1$. This is because the steps $n_1 \rightarrow n_2 \rightarrow n_3$ as shown in FIG. 3(*a*) are to be ready for the entry of time difference information after the depression of the key W or T.

The step $n_{14}$ determines whether or not the R-S type flip flop $F_2$ is in the set state. Since it remains in the reset state as shown in the step $n_7$ of FIG. 3(*a*), the step $n_{15}$ is called for which develops the micro-instruction ⑫ and transfers the contents of the output register ACC into the tens of hours and hourshours positions of the timekeeping register $R_O$. As a result, the timekeeping register $R_O$ shows the present time in the region B and subsequently keeps updating the timekeeping information by virtue of the timekeeping counter CO. There is, however, a possibility that the output register ACC may bear less than zero (minus) or more than 24 hours information according to the time $T_A$ and the relative time difference $(t_A-t_B)$ as a result of the operation $T_A+(t_A-t_B)$. Although not shown, in this case a time determination is provided which detects the contents of the output register ACC and effects addition of 24 when less than zero hours information has been resulted in and subtraction of 24 when more than 24 hours information has been resulted.

Since the R-S type flip flop $F_2$ is reset in the timepiece mode T, the logic gate $G_4$ is enabled with the inverter signal $\overline{S_C}$ and the reset signal $\overline{F_2}$ in a manner that the contents of the timekeeping register $R_O$ are displayed on the display 4 of FIG. 1 through the display register DSP. By way of example, the second register $R_2$ stores the time difference $t_A$ of Japan (say, 03) and the timekeeping register $R_O$ stores the time $T_A$ in Japan. When the digit keys "1" and "3" are manually operated to introduce the time difference of Paris and then the key W is operated, the timekeeping register $R_O$ shows the Paris time and keeps updating. The step $n_{16}$ is executed which develops the micro-instruction ⑬ and transfers the contents of the first register $R_1$ into the second register $R_2$. Thereafter, the time difference concerning Paris is treated as the time difference $t_A$ of the reference region A.

As seen from FIG. 3(*b*), upon the depression of the key T the step $n_8$ is carried through to conclude that the key W has not been operated after the data entry. The step $n_{17}$ is reached which confirms the depression of the key T and initiates the step $n_{18}$. The R-S type of flip flop $F_2$ is set by the micro-instruction. A distinction in between the depression of the keys T and K is whether or not the R-S type flip flop $F_2$ is set. Then, the steps $n_{15}$ and $n_{16}$ are not carried through. Once the flip flop $F_2$ is set, the steps $n_9 \rightarrow n_{10} \rightarrow \cdots n_{13}$ are sequentially executed as in case of the depression of the key W. This eventually leads to the fact that the output register ACC bears $T_A+t_A-t_B$. The step $n_{14}$ is not followed by the steps $n_{15}$ and $n_{16}$ because the R-S flip flop $F_2$ is already set in the step $n_{18}$, completing the time zone change procedure. The contents of the output register ACC are displayed via the display register DSP on the display 4 because the R-S type flip flop $F_2$ is set to enable the logic gate $G_4$ and disable the logic gate $G_5$. This display is stationary and the time $T_B$ in the region B is displayed at the moment where the key T is depressed. Though tens of hours and hours horological information is displayed in the above illustrated example, tens of minutes and minutes horological information also can be transferred from the timekeeping register $R_O$ to the display register DSP and thus displayed when the key T is depressed.

If the user desires to revert the time display to the initial state, the key CL should be operated to place the R-S type flip flop $F_2$ into the reset state. When the key T is depressed, the second register $R_2$ and the timekeeping register $R_O$ remain unchanged and the time $T_A$ in the region A is displayed via the logic gate $G_4$ and the display register DSP.

As noted earlier, the contents of the buffer register $R_B$ are supplied to the display register DSP through the logic gate $G_6$ responsive to the inverted signal $\overline{S_C}$ in the above described embodiment of FIG. 2. It is obvious that the time difference inputs, the time differences stored respectively within the first and second registers $R_1$ and $R_2$ also can be visually displayed to identify the information on the display 4.

In the above embodiment time differences with respect to Greenwich mean time plus 12 hours are employed as absolute ones. This makes it possible to represent all of time differences of the regions of which the times are within twelve hours of Greenwich mean time by zero or any positive integer. Moreover, this eliminates the necessity for determining advance or delay of respective time differences and provides a simplicity of a register structure. The user has not to consider a plus sign or a minus sign in introducing time difference inputs. Provided that more than twelve hours are added to respective time differences with respect to Greenwich mean time, all the regions throughout the world can be represented by zero or any positive integer. In any way, these time differences can be preselected optionally.

While a certain representative embodiment and details have been shown for the purpose of illustrating the invention, it will be apparent to those skilled in this art that various changes and modifications may be made without departing from the spirit or scope of the invention, and all such modifications as would be obvious to one skilled in the art are intended to be included within the scope of the following claims.

What is claimed is:

1. A timepiece with time zone change functions comprising:

timekeeping means for developing and storing horological information therein;

first storage means for storing a time difference of a first geographical region with respect to a specific reference region, the present time of the first geographical region being stored and updated within said timekeeping means;

means for introducing into said timepiece a time difference of a second geographical region with respect to said specific reference region, the present time of the second region being sought to be calculated by the time zone change functions;

second storage means responsive to said means for introducing for storing the time difference of the second region with respect to said specific reference region therein;

means for determining a relative time difference between said first and second geographical regions by using the contents of said first storage means and said second storage means; and means for effecting the time zone change functions of said timepiece by developing new horological information through the use of the horological information stored within said timekeeping means and the relative time difference, thereby determining the present time in the second region.

2. The timepiece according to claim 1 wherein said specific reference region comprises Greenwich mean time.

3. The timepiece according to claim 1 wherein said specific reference region comprises Greenwich mean time plus an integer.

4. A timepiece with time zone change functions comprising:

timekeeping means developing the present time $T_A$ of a first geographical region;

first register means for storing a time difference $t_A$ of the first region with respect to a specific reference region;

input means for introducing into said timepiece a time difference $t_B$ of a second geographical region with respect to said specific reference region, a present time $T_B$ of the second region being calculated by the time zone change functions of said timepiece;

subtractor means for calculating a relative time difference $(t_A - t_B)$ by subtracting the time difference $t_B$ introduced via said input means from the time difference $t_A$ stored in said first register means; and adder means for effecting the time zone change functions of said timepiece by adding the present time $T_A$ stored within said timekeeping means to the relative time difference $(t_A - t_B)$ calculated by said subtractor means, thereby determining the present time $T_B$ in the second region by performing an arithmetic operation defined by the following equation:

$$T_B = T_A + (t_A - t_B).$$

5. A calculator and timepiece with time zone change functions comprising:

timekeeping means developing the present time of a first geographical region;

first storage means for storing a time difference of the first region with respect to a specific reference;

keyboard means for introducing into said calculator and timepiece a time difference of a second geographical region with respect to said specific reference, said keyboard means constituting an input section of the calculator function of said calculator and timepiece and second storage means for storing said time difference of said second geographical region therein;

subtractor means for calculating a relative time difference from the time difference stored in said first storage means and the time difference introduced via said keyboard means and stored in said second storage means; and means for effecting the time zone change functions of said timepiece through the use of the present time developed by said timekeeping means and the relative time difference calculated by said subtractor means, thereby determining the present time of the second region.

* * * * *